United States Patent [19]

Best et al.

[11] 4,437,707

[45] Mar. 20, 1984

[54] SPRAYING NOZZLE ARRANGEMENT

[75] Inventors: Gerd Best, Sprockhövel; Günter Dlugosch, Bönen, both of Fed. Rep. of Germany

[73] Assignee: Krampe & Co. Fertigung in Bergbaubedarf GmbH, Hamm, Fed. Rep. of Germany

[21] Appl. No.: 340,722

[22] Filed: Jan. 19, 1982

[30] Foreign Application Priority Data

Jul. 16, 1981 [DE] Fed. Rep. of Germany ..... 3128049

[51] Int. Cl.[3] ..... E21C 35/22

[52] U.S. Cl. ..... 299/81; 175/393

[58] Field of Search ..... 299/81; 175/340, 393

[56] References Cited

U.S. PATENT DOCUMENTS 2,634,101 4/1953 Sloan ..... 175/340 X
2,885,186 5/1959 Hammer ..... 175/340
3,744,581 7/1973 Moore ..... 175/340
4,268,089 5/1981 Spence et al. ..... 299/81 X

FOREIGN PATENT DOCUMENTS 1309005 3/1973 United Kingdom ..... 299/81

*Primary Examiner*—Ernest R. Purser
*Attorney, Agent, or Firm*—Michael J. Striker

[57] ABSTRACT

A spraying nozzle for a cutting roller for underground mining, which is located in the vicinity of the cutting bit provided on the blade or closure ring of the roller, has a nozzle shield enclosing the nozzle and coaxially mounted therewith on the respective blade or closure ring of the roller. The nozzle shield is formed with a recess to receive the head of the nozzle and has an upper surface sloping in a direction opposite to the direction of rotation of the cutting roller to reduce wear of the nozzle shield subject to flowing abrasive mineral mined.

13 Claims, 3 Drawing Figures

SPRAYING NOZZLE ARRANGEMENT

BACKGROUND OF THE INVENTION

This invention relates to a cutting roller for a mining machine. More particularly, the invention relates to a spraying nozzle arrangement for spraying liquid on the bits located on the periphery of the cutting roller.

The prior art involves cutting rollers for mining machines used in underground mining, particularly for use in coal mining. Cutting rollers of this kind usually consist of a cylindrical tubular housing or body on which one or more cutting blades is or are welded so as to extend helically about the tubular housing. Welded to the outside of the blades at regular intervals are bit holders in which cutter bits are mounted. The end of the cutting roller facing towards the face of the workings is closed off by an end plate.

The known cutting rollers are equipped with spraying nozzles which are installed by means of screw threads in so-called nozzle inserts which are, for example, made out of material under trademark NIROSTA. These nozzle inserts are welded to the blades or closure ring so as to form a one-piece item therewith. The spraying nozzles may be enclosed with nozzle shields which are usually designed as rings extended outwardly from the nozzles, these rings being made out of wear-resistive steel because they are exposed to abrasive minerals.

The disadvantage of these otherwise satisfactory spraying nozzle arrangements is that the nozzle shields of the prior art wear out quickly due to their constant exposure to mineral mined and thus to constant relatively high resistance to mineral particles discharged. Particularly disadvantageous is the fact that in a circular space, in which the nozzle head is located, dust, liquid and rock chips may be collected which can prevent the spraying nozzles from proper functioning. Furthermore, the prior art arrangements make it impossible to clean nozzle shields of individual nozzles during operation. All commercially available spraying nozzle arrangements for cutting rollers utilized for underground mining possess the aforementioned disadvantages.

SUMMARY OF THE INVENTION

It is an object of this invention to avoid the disadvantages of the prior art.

It is a further object of the invention to provide an improved spraying nozzle arrangement.

These and other objects are attained by a spraying nozzle arrangement for a cutting roller for use in a mining machine and rotatable in a predetermined direction, the cutting roller having at least one cutting member having a periphery and provided with at least one cutting bit, the arrangement being mounted on said cutting member in the vicinity of the associated cutting bit and comprising a spraying nozzle having a central axis; and a nozzle shield mounted coaxially with the spraying nozzle and having an upper face facing outwardly of the nozzle, said upper face tapering in a direction opposite to said predetermined direction starting from the periphery of the cutting member and ending at the region located below the upper face.

The cutting members of the cutting roller include blades or coils carrying cutting bits and a closure ring also carrying a number of cutting bits, the arrangements of the invention being mounted on the blades and closure ring.

The nozzle shield in the direction of rotation of the cutting roller may have a stream-like shape.

In the design of the nozzle arrangement of the invention almost automatic cleaning of the nozzle shields may take place during the operation, and wear of the components of the nozzle arrangement may be reduced. The cleaning of the internal recess in the nozzle shield, in which the head of the nozzle is positioned, can be performed almost automatically because during the operation of the rotating cutting roller mineral discharged is conveyed in an outward direction from the recess or depression receiving the nozzle. As a result, this depression of the ring-shaped nozzle shield is not clogged.

A further advantage of the stream-like shaped nozzle shield resides in reducing of resistance of the shield to abrasive minerals as compared to those ring-shaped shields known in the art. This results in considerable reduction of wear of the nozzle shields and saving of the drive energy.

Due to the provision of the tapering portion of the nozzle shield sloping in a direction opposite to the direction of rotation of the cutting roller there is practically no material subject to wear available in the designed structure. The nozzle shield in the predetermined direction may define a front portion facing towards the associated cutting bit.

This front portion may be of a wedge-shape and may terminate at its end facing said cutting bit with a rounded surface.

The upper face of the nozzle shield may taper in such a fashion that it forms a first portion sloping from said periphery at a first angle, and a second portion sloping from the end of said first portion at a second angle relatively larger than said first angle.

The nozzle shield may be formed with a countersink defining a space for receiving the spraying nozzle.

The nozzle shield may further define in the direction of rotation of the cutting roller a rear portion, said front portion merging into said rear portion, said rear portion starting at a predetermined distance from the central axis of the spraying nozzle, said distance being defined by a transition between a first sloped portion and a second sloped portion of the nozzle shield, said rear portion being of a substantially rectangular shape and being enclosed with the wedge-shaped front portion of the nozzle shield.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
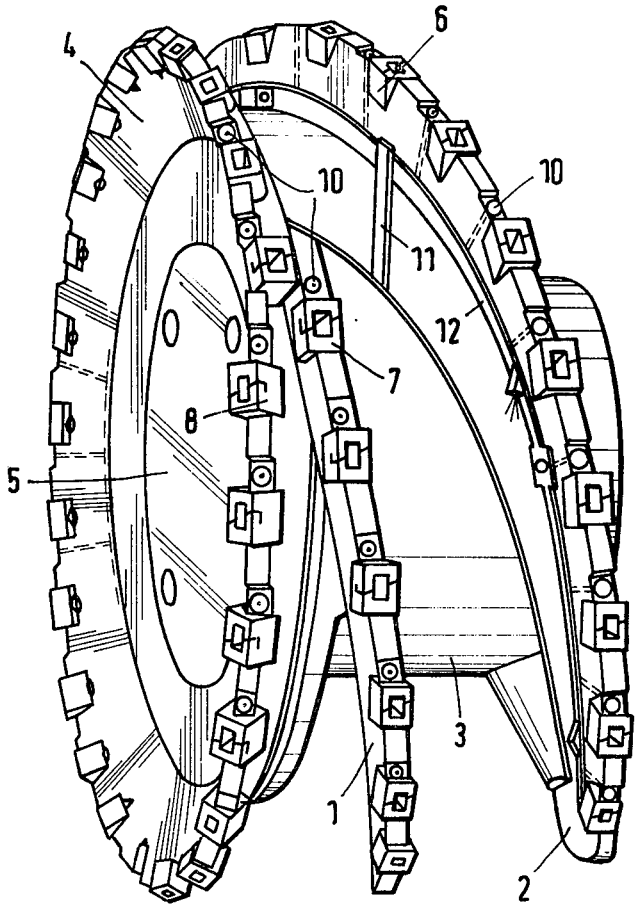
FIG. 1 is a perspective view of a cutting roller for a mining machine, according to the invention.

In the drawings, the invention is illustrated with reference to a cutting roller which may advantageously be used particularly in underground coal mining.

Referring first to FIG. 1 reference characters 1 and 2 designate blades or coils or vanes provided on the cutting roller, which blades extend about a tubular body member 3 and are rigidly secured thereto, for example by welding.

The cutting roller at its end facing towards the mineral workings (not illustrated herein) is equipped with a conical closure ring 4 which is rigidly mounted to the body member 3, for example by means of welding.

The working side face of the cutting roller is closed with a cover 5. Both blades 1 and 2 and closure ring 4 are provided with a plurality of bit holders 6, 7, and 8 mounted on the periphery of the respective blades and holding cutting bits 9 (shown in FIG. 2 in detail).

The cutting roller illustrated in FIG. 1 is furnished with a so-called individual spraying nozzle system in which each bit 9 has its own spraying nozzle 10 which conveys spraying liquid in a suitable manner through channels 11, 12 and 13. The spraying jet can be directed in such a fashion that it hits one-third of the bit 9, or in the case of another suitable fashion, the spraying jet (as seen in FIG. 2) may be reflected normal to the body member, in this case spraying mist generated during the rotation of the roller will also moisten the cutting bits 9 and the latter will be sufficiently cooled.

Figure 2:
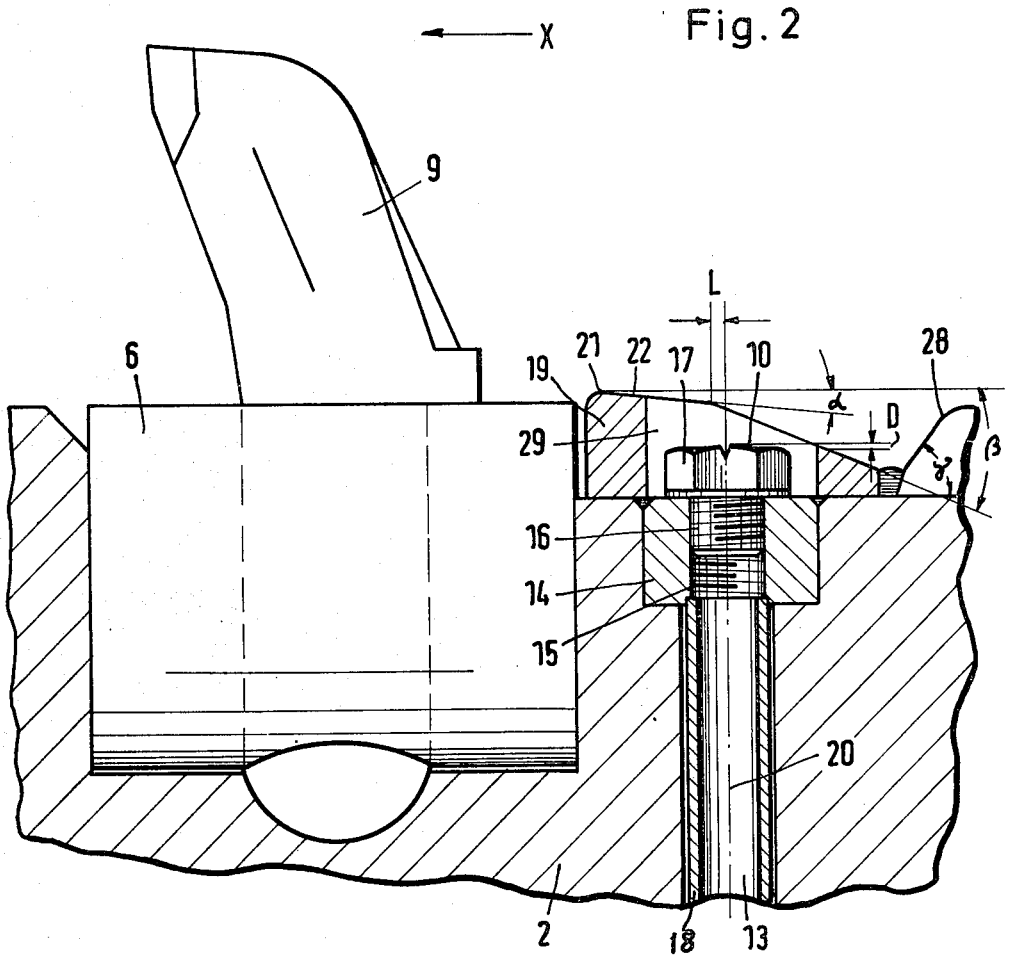
FIG. 2 is a cutaway view, partially in section, of a blade carrying a cutting bit, with a spraying nozzle arrangement on a larger scale.

With reference to FIG. 2 it can be seen that the spraying nozzle generally denoted as 10 is arranged behind a respective bit 9 as viewed in a direction X of rotation of the cutting roller. The reference numeral 14 denotes a nozzle insert, preferably made out of anticorrosive steel, for example of the material having a trademark NIROSTA. The spraying insert 14 is mounted in a recess formed in the blade 1, 2 or enclosure ring 4 and is secured thereto by means of welding. The outer surface of each insert 14 is flush with the outer periphery of the respective recess of the blade or closure ring. The spraying insert 14 has a bore with an inner thread 15, in which a spraying nozzle 16 having an outer hexagonal portion 17 is loosely received. Coaxially with the spraying nozzle is mounted a tube 18 formed of an anticorrosive material, such as synthetic plastic material or rust-resistive steel, tube 18 forming a channel 13.

Also coaxially with the spraying nozzle 10 but at the side thereof opposite to tube 18 is arranged a nozzle screen or shield 19 of high-wear-resistive material, for example viscous steel, synthetic plastic material (pasted) or ceramic (pasted). This nozzle shield forms a circular collet or collar normally projecting from the periphery of the respective blade (blade 2 is depicted in FIG. 2) or closure ring, the collet forming a countersink in which outer hexagonal portion 17 of spraying nozzle 16 is positioned.

Reference character 20 designates a central axis of the nozzle 10. As seen in FIG. 2 an outer front face 21 of nozzle arrangement 10 is inclined at an angle $\alpha$ in the direction opposite to the direction X of rotation of the cutting roller. This angle may vary between 0° and 20°, preferably between 0° and 15°. Reference numeral 22 denotes a slope which ends at a distance L before the central axis 20. The dimension L is in the range about between zero and 30 mm, preferably between zero and 5 mm.

Figure 3:
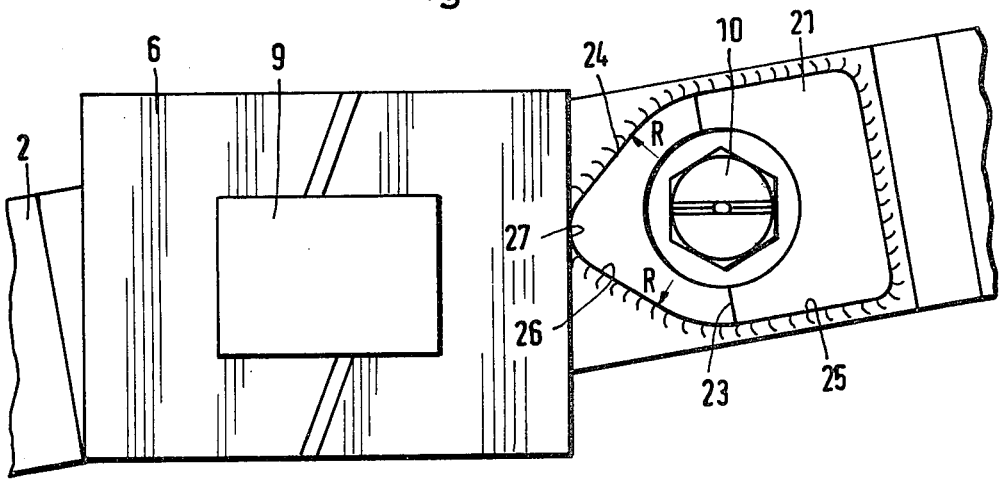
FIG. 3 is a partial plan view of FIG. 2.

The slope 22 from the point defined by the distance L from the central axis extends at an angle $\beta$ which is larger than angle $\alpha$ and is in the range about between 15° and 45°, preferably between 20° and 30°. This results in a peripheral edge 23 formed at a transition zone shortly before the central axis 20, which peripheral edge is shown in FIG. 3. Dimension D shown in FIG. 2 is between zero and 10 mm, preferably 3 mm.

FIG. 3 shows a plan view of the nozzle shield 19 which has a front portion 24 extending in the direction X and provided to reduce resistance to the flow of abrasive mineral. Shield 19 in the embodiment illustrated herein, has in its plan view a rectangular portion 25 which merges from the peripheral edge 23 and via radii R into the narrowing wedge-shaped portion 24 extending in direction X. The wedge-shaped portion 24 has sloped surfaces 26 and is rounded at its end with a smooth radius 27 so that the entire resistance-reducing structure in direction X is obtained, which structure has a stream-like shape and offers little attack surfaces for a mineral mined. The nozzle shield 19 may be connected to the respective blade or enclosure ring by welding.

Reference character 28 shows a depression in blades 1 or 2 or closure ring 4, in which the bit holder 6 and the nozzle shield 19 are arranged. As seen in FIG. 2 the depression is inclined to a horizontal (in the plane of the drawing) at an acute angle. In such a construction a mineral discharged and driven into a space 29 will be automatically pushed out of the space 29 in a direction opposite to direction X and thus will not be compacted within the nozzle arrangement 10.

It will be understood that each of the elements described above, or two or more together, may also find a useful application in other types of spraying nozzle arrangements differing from the types described above.

While the invention has been illustrated and described as embodied in a spraying nozzle arrangement for a cutting roller, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A spraying nozzle arrangement for a cutting roller for use in a mining machine and rotatable in a pre-determined direction, the cutting roller having at least one cutting member having a periphery and provided with at least one cutting bit, the arrangement being mounted on said cutting member in the vicinity of the associated cutting bit and comprising a spraying nozzle having a central axis; and a nozzle shield enclosing said spraying nozzle and mounted coaxially therewith and having an upper face facing outwardly of said nozzle, said upper face tapering in a direction opposite to said pre-determined direction starting from the periphery of the cutting member and extending to the region located below said upper face, said nozzle shield having in said predetermined direction a stream-like shape and defining said predetermined direction a front portion facing towards said cutting bit, said front portion being of a wedge-shape and terminated at its end facing said cutting bit with a rounded surface, wherein said upper face tapers in such a fashion that it forms a first portion sloping from said periphery at a first angle, and a second portion sloping from the end of said first portion at a second angle relatively larger than said first angle.

2. The spraying arrangement of claim 1, wherein the cutting members are blades and a closure ring, the spraying nozzle arrangements being mounted on the blades and on the closure ring.

3. The spraying arrangement of claim 2, wherein said nozzle shield is formed with a countersink defining a space for receiving said spraying nozzle.

4. The spraying arrangement of claim 3, wherein said first portion and said second portion of said upper face form an outer boundary edge for said space.

5. The spraying arrangement of claim 4, further including an insert mounted in a recess provided in said cutting member and having a bore in which said spraying nozzle is received.

6. The spraying arrangement of claim 5, wherein said spraying nozzle includes a hexagonal outer portion outwardly extended from said recess and located in said space.

7. The spraying arrangement of claim 6, said hexagonal outer portion having an outer surface, the end of said boundary edge in the region of said second sloped portion being located slightly below said outer surface.

8. The spraying arrangement of claim 7, wherein said nozzle shield further defines in said predetermined direction a rear portion, said front portion merging into said rear portion, said rear portion starting at a predetermined distance from said central axis of said spraying nozzle, said distance being defined by a transition between said first sloped portion and said second sloped portion, said rear portion being of a substantially rectangular shape and being enclosed with said wedge-shaped front portion.

9. The spraying arrangement of claim 8, wherein the arrangement is positioned behind the associated cutting bit in said predetermined direction.

10. The spraying arrangement of claim 8, wherein said insert is rigidly connected to said cutting member.

11. The spraying arrangement of claim 10, wherein said nozzle shield is rigidly connected to said cutting member.

12. The spraying arrangement of claim 2, wherein said spraying nozzle is connected to a source of spraying liquid by channels.

13. The spraying arrangement of claim 12, further including a tubular element arranged in the cutting member and connected to said spraying nozzle, said tubular element forming one of said channels.

* * * * *